US005518482A

United States Patent [19]

Hsieh

[11] Patent Number: 5,518,482

[45] Date of Patent: May 21, 1996

[54] MULTIPLE FUNCTION EXERCISE APPARATUS

[75] Inventor: Yi F. Hsieh, Succasunna, N.J.

[73] Assignee: Lifegear, Inc., Rockaway Township, N.J.

[21] Appl. No.: 319,440

[22] Filed: Oct. 6, 1994

[51] Int. Cl.[6] ..... A63B 21/04

[52] U.S. Cl. ..... 482/130; 482/138; 482/133

[58] Field of Search ..... 482/121, 122, 482/123, 129, 130, 138, 133

[56] References Cited

U.S. PATENT DOCUMENTS

| | | | |
|---|---|---|---|
| 4,240,627 | 12/1980 | Brentham | 482/138 |
| 5,277,681 | 1/1994 | Holt | 482/138 |
| 5,393,286 | 2/1995 | Cheng | 482/130 |
| 5,409,439 | 4/1995 | Lee | 482/130 |

OTHER PUBLICATIONS

Model 17–J220 and 17–J221 Hip & Thigh Machine Brochure of Diversified Product Corporation, Dec. 23, 1993.

*Primary Examiner*—Lynne A. Reichard
*Attorney, Agent, or Firm*—David L. Davis

[57] ABSTRACT

An exercise apparatus having a seat and a pair of interconnected pivoting thigh exercising arms which are selectively yieldably biased to exercise either the user's outer or inner thigh muscles. In addition, a foot exercise assembly is provided so that the apparatus can function as a recumbent stepper exerciser.

12 Claims, 5 Drawing Sheets

MULTIPLE FUNCTION EXERCISE APPARATUS

BACKGROUND OF THE INVENTION

This invention relates to exercise apparatus and, more particularly, to apparatus for selectively exercising the user's gluteus maximus, thigh adductors and thigh abductors.

In recent years, people have become more interested in physical fitness. However, regular attendance at a gym or health club can be expensive and/or inconvenient for many people. Accordingly, there is a need for exercise equipment which can be utilized in the home. For reasons of economy, such equipment should be relatively inexpensive, while at the same time affording the user the opportunity to perform more than one type of exercise on such apparatus.

One such type of home exercise apparatus is the Model 17-J220 and 17-J221 hip and thigh machine sold by Diversified Products Corporation under the name "Body by Jake". This apparatus provides both a leg press device which allows the user to work the gluteus maximus muscles in the buttocks and the top and back of the thighs and a thigh press device which allows the user to exercise both the inner and outer thigh muscles (adductors and abductors). However, this apparatus possesses a number of disadvantages. For example, when exercising the thigh muscles, there is no coordination between the left and right thighs with respect to extent and speed of thigh motion. Also, when using the leg press device, both legs must be moved together, which limits the speed of movement and prevents the user from having an aerobic workout.

It is therefore an object of the present invention to provide an exercise apparatus of the type described which does not suffer from the aforementioned disadvantages.

SUMMARY OF THE INVENTION

The foregoing, and additional, objects are attained in accordance with the principles of this invention by providing exercise apparatus comprising a frame having a pair of spaced base members adapted to be supported on a surface and an elongated support member connected to the base members, the support member defining a longitudinal axis of the frame. A seat is fixedly supported on the frame and a pair of arms are each pivotally mounted at a first end of each arm to the support member remote from a first end of the support member. Each of the arms is arranged for pivotal movement about a respective pivot axis transverse to the frame supporting surface, the pivot axes being parallel to each other, and the arms extending laterally outward from the frame longitudinal axis and toward the support member first end. The arms are interconnected so as to pivot one with the other in opposite angular directions. First biasing means yieldably biases the pair of arms selectively in one or the other angular direction. A pair of thigh supports are each mounted to a respective arm remote from the respective arm first end, with each of the thigh supports having a support portion and a transverse portion. A foot support assembly is pivotally mounted to the frame remote from the seat about an axis parallel to the frame supporting surface and orthogonal to the frame longitudinal axis, and second biasing means yieldably biases the foot support assembly toward the seat.

In accordance with an aspect of this invention, the foot support assembly comprises a pair of independent pivotally mounted foot holder subassemblies and the second biasing means comprises independent biasing means for each of the foot holder subassemblies.

In accordance with another aspect of this invention, each of the arms has a circular gear segment centered at the respective arm pivot axis and secured to the first end of that arm. The gear segments of the two arms are intermeshed when the arms are mounted to the support member.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
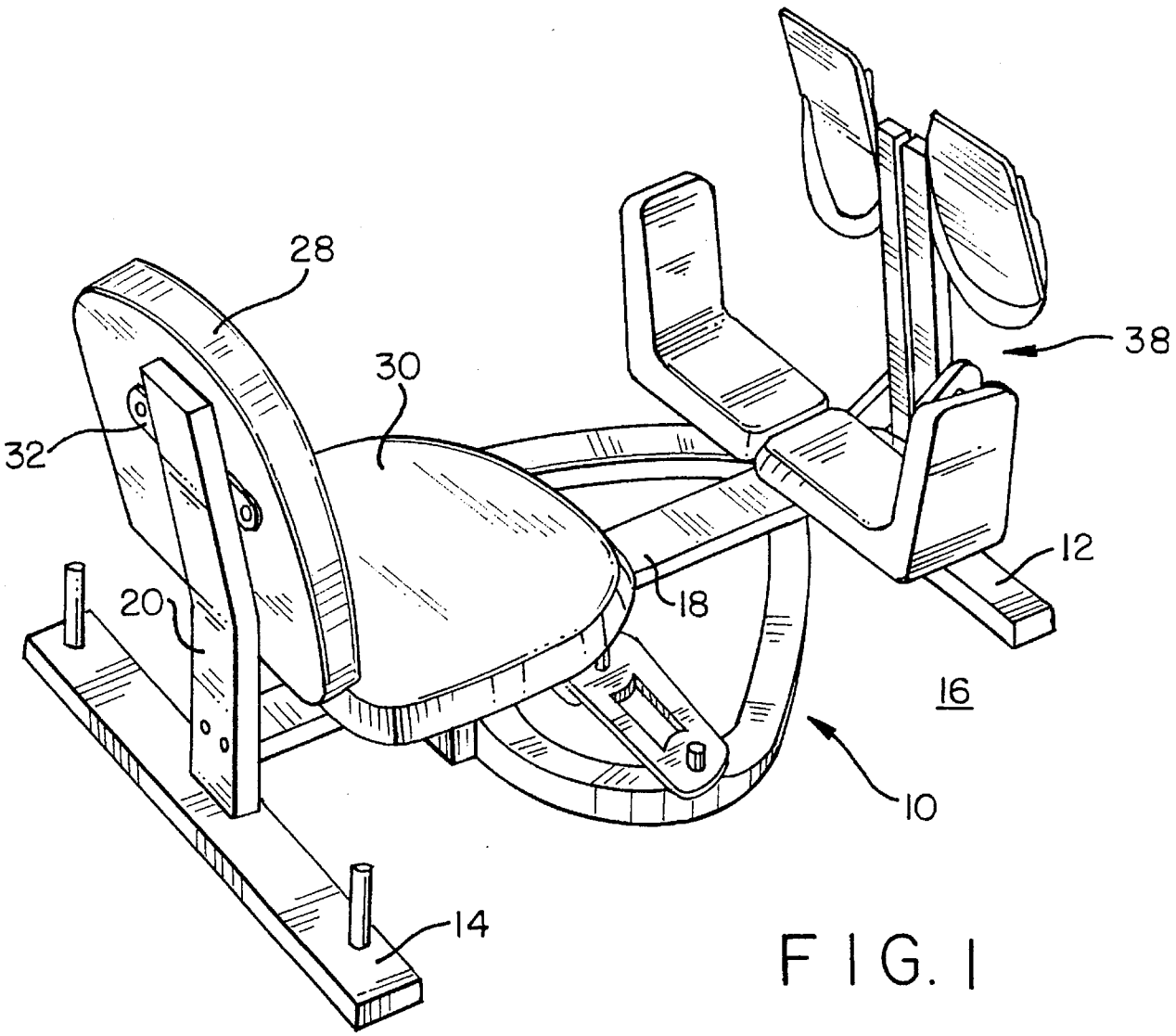
FIG. 1 is a perspective view of exercise apparatus constructed in accordance with the principles of this invention.
Figure 2:
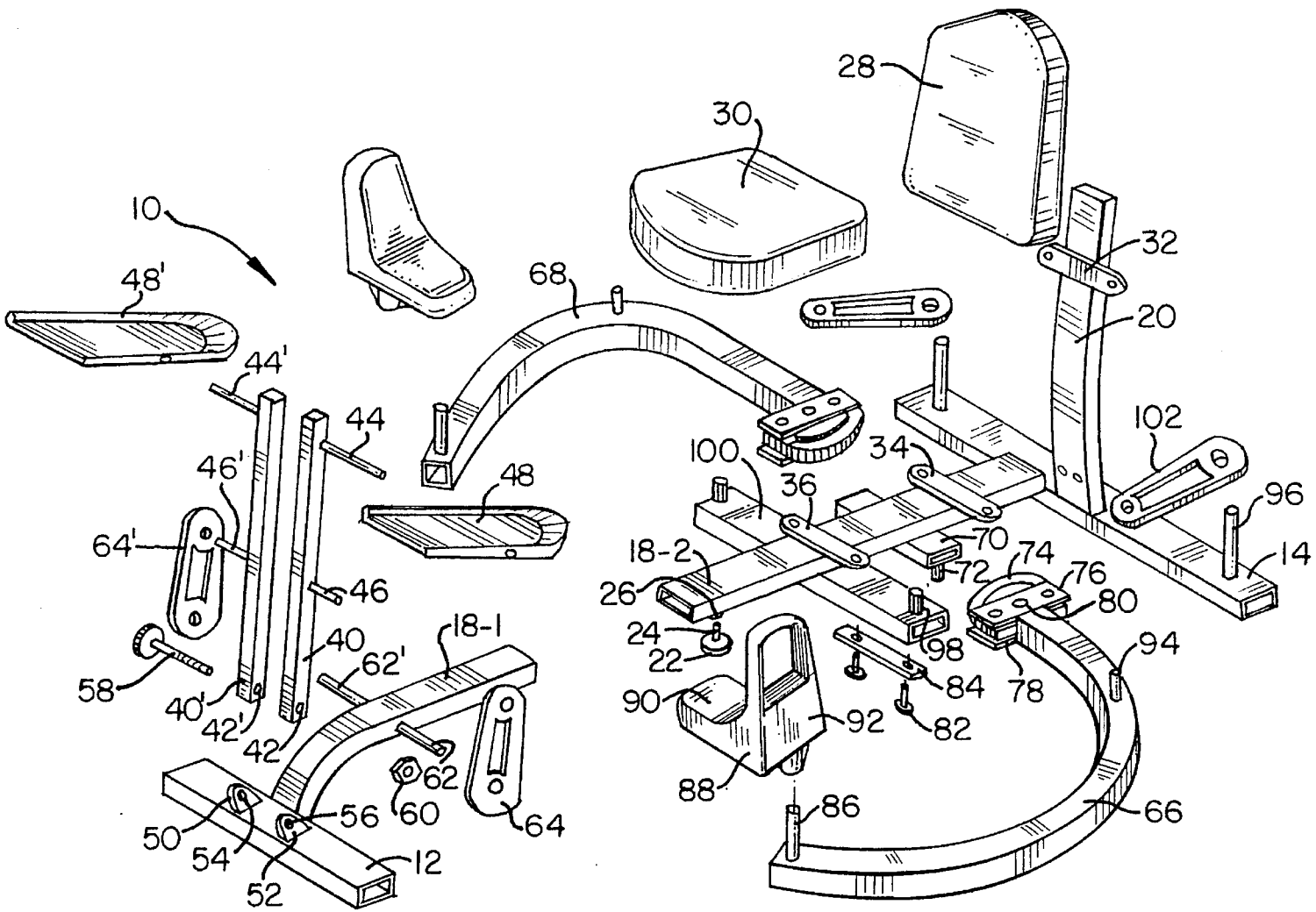
FIG. 2 is an exploded perspective view showing the major components of the apparatus of FIG. 1.

Referring now to the drawings, exercise apparatus 10 constructed in accordance with the principles of this invention includes a front base member 12 and a rear base member 14 supported on a surface 16, such as a floor. The base members 12 and 14 make up part of the frame of the apparatus 10, along with an elongated support member 18 connected to the base members 12, 14. The support member 18 defines a longitudinal axis of the frame of the apparatus 10 and includes a first part 18-1 secured to the front base member 12 and a second part 18-2 secured to an upstanding post 20 which is in turn secured to the rear base member 14. The second support member part 18-2 is preferably linear and is secured to the post 20 above the base member 14 so that it is spaced from and generally parallel to the supporting surface 16. The support member part 18-1 is secured directly to the base member 12 and is partially curved and partially straight so that it is spaced from the support surface 16 and is sized so that it telescopes into the interior of the support member part 18-2. Thus, the length of the support member 18, and hence the spacing between the base members 12, 14 is adjustable. To secure the parts 18-1, 18-2, there is provided a knob 22 attached to a threaded spindle 24. A nut 26 having a threaded interior is secured to the underside of the part 18-2, as by welding, concentric with a hole in the underside of the part 18-2. After the part 18-1 is inserted into the part 18-2 and the appropriate length of the frame is selected, the knob 22 is turned so that the spindle 24 extends into the interior of the part 18-2. The part 18-1 may be formed with a series of spaced openings on its underside into which the spindle 24 can extend or, alternatively, frictional engagement between the end of the spindle 24 and the underside of the part 18-1 holds the part 18-1 secure relative to the part 18-2.

A seat including a back portion 28 and a seat portion 30 is fixedly supported on the frame of the apparatus 10, illustratively by means of a bar 32 secured to the post 20 and the bars 34, 36 secured to the support member part 18-2.

For exercising the gluteus maximus muscles in the buttocks and the top and back of the thighs, as well as for providing an aerobic workout, a foot support assembly 38 is pivotally mounted to the frame at the end remote from the seat. The foot support assembly 38 includes a pair of independent pivotally mounted foot holder subassemblies. The first subassembly includes a bar 40 having a through hole 42 at one end, a post 44 secured at its other end orthogonal to the elongate direction of the bar 40, and a post 46 secured to the bar 40 orthogonally thereto and substantially midway between the hole 42 and the post 44. The posts 44 and 46 are parallel. The post 44 is a pivot axle on which the foot pad 48 is mounted. The second foot holder subassembly is of identical construction, as indicated by the primed reference numerals, but is arranged to be the mirror image of the first subassembly. The front base member 12 is formed with a pair of upstanding tabs 50, 52, each of which is formed with a respective through hole 54, 56. The holes 54 and 56 are coaxial. A threaded bolt 58 is passed through the hole 54, the hole 42', the hole 42 and the hole 56, and is secured by the nut 60 to pivotally mount the foot support assembly 38 to the base member 12. The support member part 18-1 is formed with a pair of posts 62, 62' extending in colinear fashion from opposite sides of the support member part 18-1. The posts 62 and 62' are orthogonal to the longitudinal axis of the support member 18. A pair of elastic members 64, 64' are provided. The elastic members 64, 64' each have openings at opposite ends thereof so that they can be secured to the posts 62, 62' and the posts 46, 46' respectively, so as to yieldably bias the foot holder subassemblies toward the seat. Different strength elastic members 64, 64' can be provided to accommodate different exertion levels for the user.

For exercising the thigh adductors and thigh abductors, the apparatus 10 is provided with a pair of thigh exercising arms 66 and 68. Since the arms 66, 68 are substantially identical, being mirror images, only the arm 66 will be described in full detail, it being understood that such description applies as well to the arm 68. Thus, the arm 66 is arranged for pivotal mounting to the support member part 18-2 which has, for such purpose, a cross beam 70 secured to its lower side, as by welding or the like. The cross beam 70 has secured thereto at each end, and depending downwardly therefrom, a pivot post 72. The pivot post 72 is preferably internally threaded. At a first end of the arm 66, there is secured a circular gear segment 74, illustratively by being sandwiched between the spaced plates 76, 78 welded to opposite sides of the arm 66. A through hole 80 extending through the plate 76, through the arm 66 and through the plate 78 defines the pivot axis of the arm 66. The hole 80 is concentric with the gear segment 74. A threaded bolt 82 extends through an opening in the plate 84 and through the hole 80 and is threadedly received within the pivot post 72 so as to secure the arm 66 for pivotal motion about the pivot post 72. The arm 68 is similarly constructed and mounted and the gear segments at the ends of the arms 66, 68 are so dimensioned that when the arms 66, 68 are mounted to the frame, the gear segments are intermeshed, resulting in the arms being interconnected so as to pivot one with the other in opposite angular directions.

The arm 66 is preferably curved and, when mounted, extends laterally outward from the support member 18 and toward the base member 12. At the distal end of the arm 66 there is secured an upwardly extending mounting post 86. A thigh support 88 having a support portion 90 and a transverse portion 92 is arranged with a bore so that the thigh support 88 can be slipped onto the mounting post 86 for rotation thereabout.

In order to provide a resistive force against which the user exerts, the arm 66 is provided with an upwardly extending post 94 between its two ends, preferably near its center. The rear base member 14 is provided with a similar post 96, and another post 98 is secured to a cross beam 100 mounted to the underside of the support member part 18-2. An elastic member 102 provides the resistive force. The elastic member 102 has openings at its two ends and can be selectively connected to the post 94 and the post 96 or to the post 94 and the post 98, as will be described in full detail hereinafter. The arrangement of the posts 94, 96 and 98 is such that the posts 96 and 98 are on opposite sides of a line from the post 94 to the pivot axis of the arm 66 so that the selective connection of the elastic member 102 either to the posts 94 and 96 or to the posts 94 and 98 biases the arm 66 in opposite angular directions.

Figure 3:
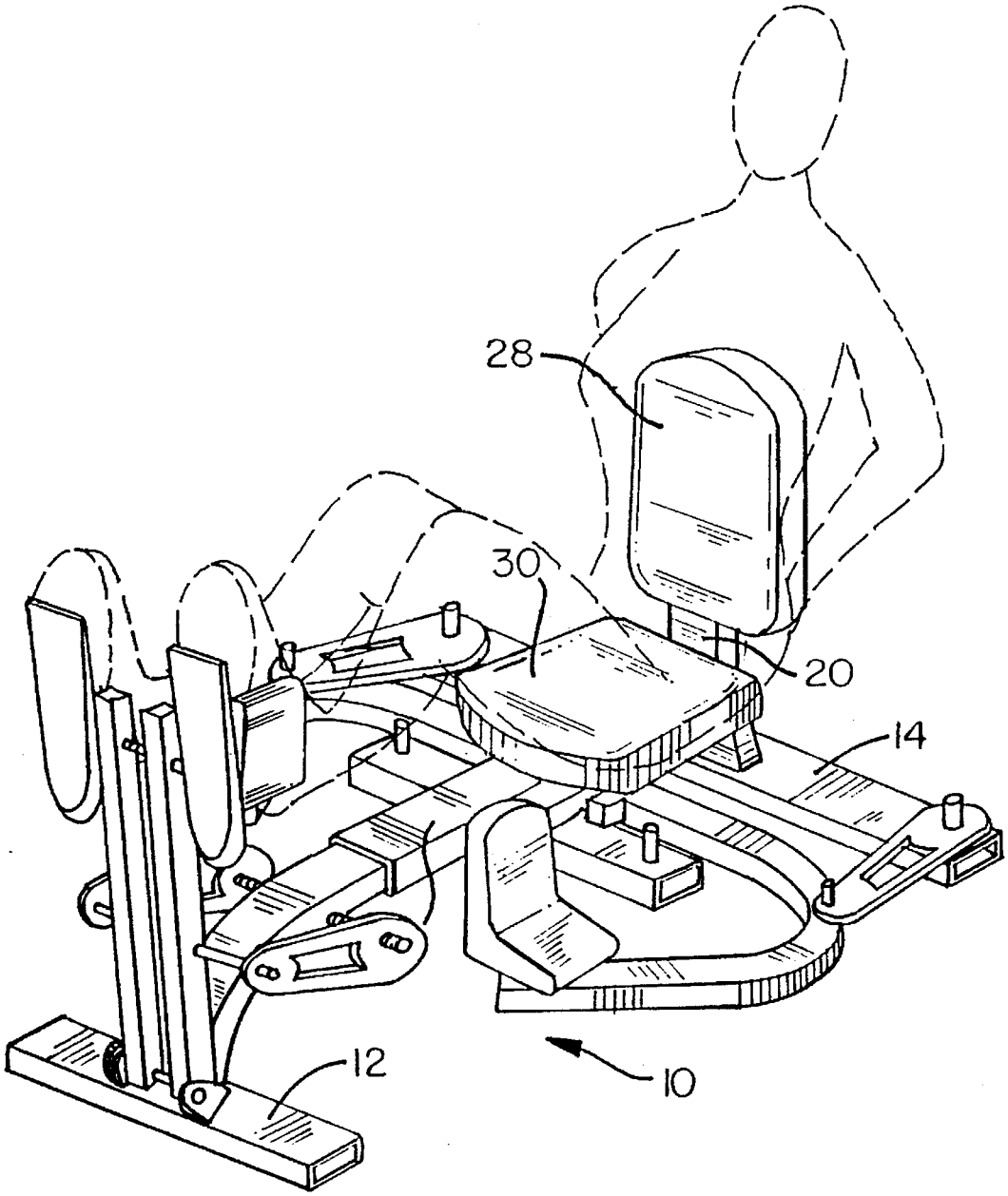
FIG. 3 is a perspective view, with a user shown in broken lines, illustrating the use of the apparatus of FIG. 1 for working the gluteus maximus muscles in the buttocks and the top and back of the thighs.

As shown in FIG. 3, when the user wishes to exercise utilizing the foot support assembly 38, the arms 66 and 68 are moved out of the way as, for example, by placing the elastic member 102 on the posts 94 and 96. Elastic members 64, 64' of suitable resistance are installed on the posts 62, 46 and 62' and 46'. The exercise apparatus thus takes the form of a recumbent stepper exerciser and the user can obtain an aerobic workout while exercising the gluteus maximus muscles in the buttocks and the top and back of the thighs by alternately reciprocating his/her legs. Alternatively, if an aerobic workout is not desired, the exercise apparatus 10 can be utilized as a leg press device by moving the legs together.

Figure 4:
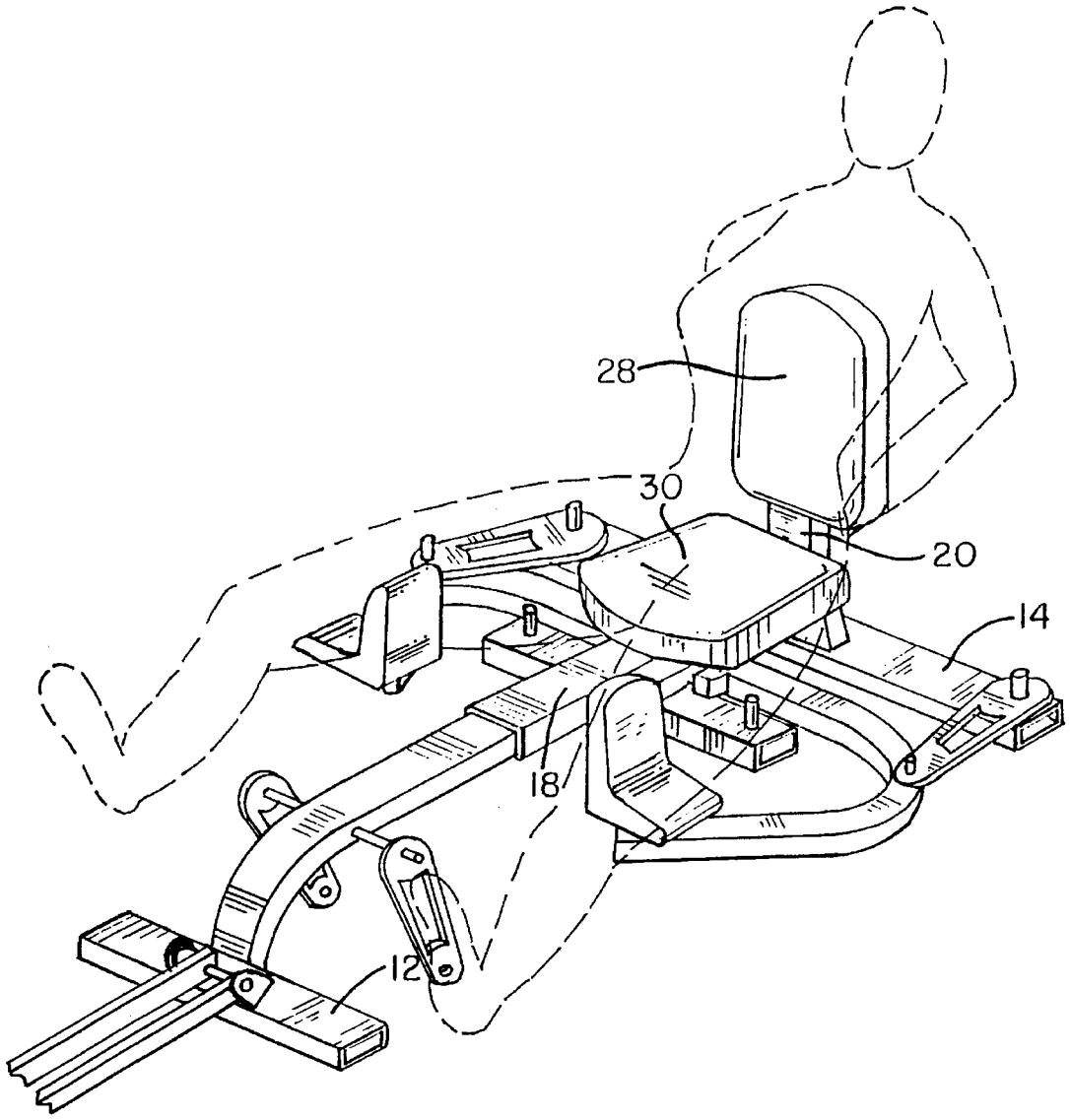
FIG. 4 is a perspective view, with a user shown in broken lines, illustrating the use of the apparatus of FIG. 1 for working the inner thigh adductor muscles.

To utilize the exercise apparatus 10 for working the inner thigh muscles, the elastic members 102 are slipped over the posts 94 and 96, as shown in FIG. 4. This biases the arms 66 and 68 outwardly. The thigh supports 88 are rotated on their mounting posts 86 so that the transverse portions 92 are inward of the support portions 90. While seated on the seat, the user places his/her thighs on the support portions 90 and works the inner thigh muscles by moving the arms 66 and 68 against the force of the elastic members 102. Different strength elastic members may be utilized for providing different exercise levels.

When the user desires to exercise the outer thigh muscles, the elastic members 102 are connected between the posts 94 and 98 and the thigh supports 88 are rotated so that the transverse portions 92 are outward of the support portions 90. The user then exercises by moving the arms 66, 68 outwardly against the inward biasing force of the elastic members 102.

Figure 5:
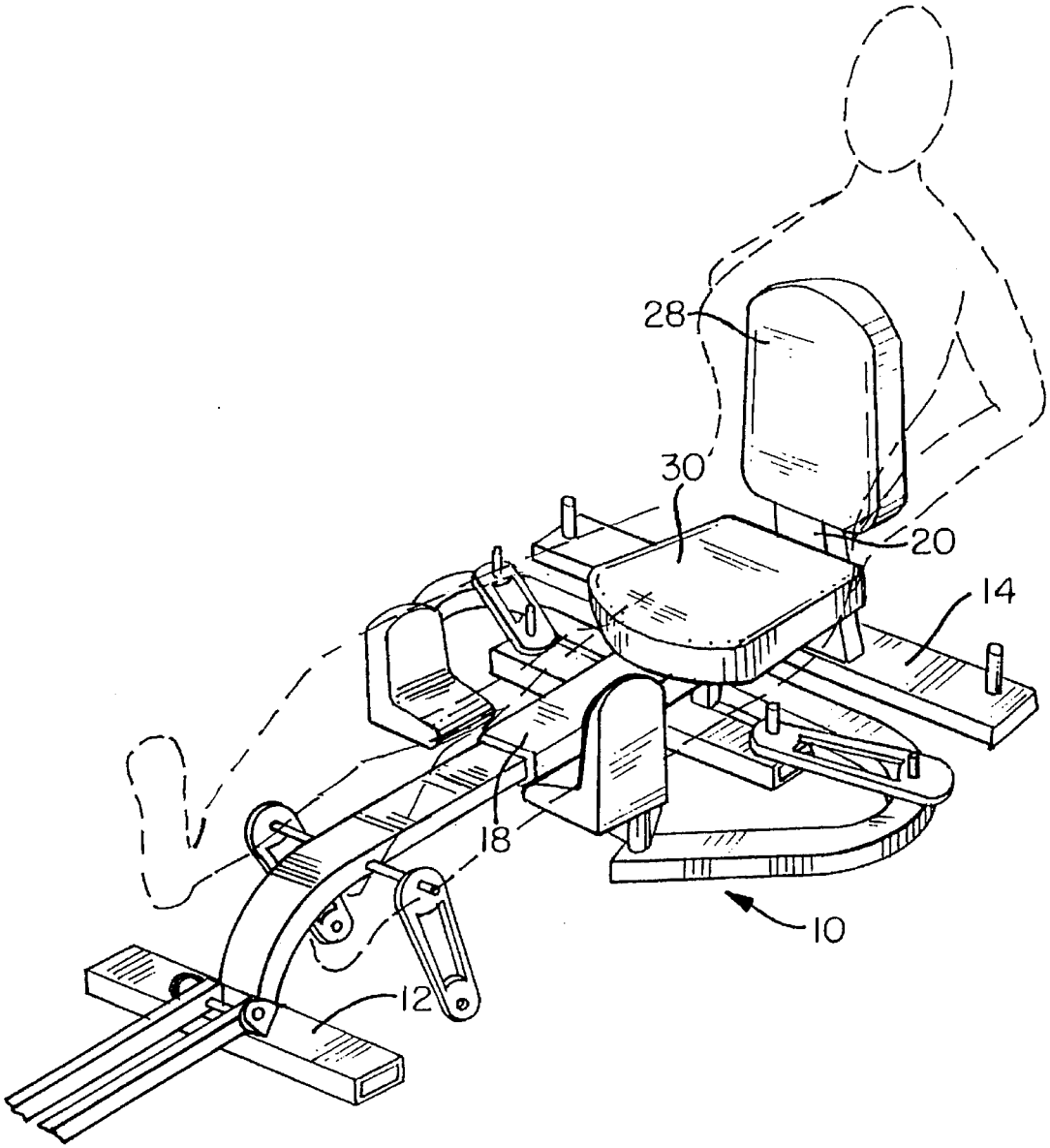
FIG. 5 is a perspective view, with a user shown in broken lines, illustrating the use of the apparatus of FIG. 1 for working the outer thigh abductor muscles.

If the foot support assembly 38 interferes with the thigh exercises illustrated in FIGS. 4 and 5, the elastic members 64, 64' may be removed and the posts 40, 40' may be pivoted to lie on the floor 16 and be out of the way.

Thus, the exercise apparatus 10 disclosed herein possesses a number of advantages over similar prior art apparatus. Since the foot support assembly 38 includes two independently operable subassemblies, the apparatus can be used as a recumbent stepper to provide an aerobic workout, since moving one's feet alternately can be done at a faster rate than moving one's feet in unison. Also, a variety of exercises can be performed since the feet can be moved either alternately or in unison. Further, by providing the circular gear segments 74 to interconnect the arms 66 and 68, this results in both arms being moved equal distances at equal speeds, to insure that the user gets equal workouts in both thighs. Further, more variations in the resistance force are possible since either or both of the thigh exercise arms 66, 68 can be provided with an elastic member.

Accordingly, there has been disclosed an improved exercise apparatus for selectively exercising the user's gluteus maximus, thigh adductors and thigh abductors. While an illustrative embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. Exercise apparatus comprising:

a frame having a pair of spaced base members adapted to be supported on a surface and an elongated support member connected to said base members, said support member defining a longitudinal axis of said frame;

a seat fixedly supported on said frame;

a pair of arms each pivotally mounted at a first end of said each arm to said support member remote from a first end of said support member, each of said arms being arranged for pivotal movement about a respective pivot axis transverse to the frame supporting surface, said pivot axes being parallel to each other, said arms extending laterally outward from said frame longitudinal axis and toward said support member first end, and said arms being interconnected so as to pivot one with the other in opposite angular directions, wherein each of said arms has a circular gear segment centered at the respective arm pivot axis and secured to the first end of said each arm, the gear segments of the two as being intermeshed when the arms are mounted to the support member;

first biasing means for yieldably biasing said pair of arms selectively in one or the other angular direction;

a pair of thigh supports each mounted to a respective arm remote from the respective arm first end, each of the thigh supports having a support portion and a transverse portion;

a foot support assembly pivotally mounted to said frame remote from said seat about an axis parallel to the frame supporting surface and orthogonal to the frame longitudinal axis; and second biasing means for yieldably biasing said foot support assembly toward said seat.

2. The exercise apparatus according to claim 1 wherein:

said foot support assembly comprises a pair of independent pivotally mounted foot holder subassemblies; and said second biasing means comprises independent biasing means for each of said foot holder subassemblies.

3. The exercise apparatus according to claim 2 wherein:

each of said foot holder subassemblies includes a bar pivotally mounted to said frame at one end of said bar and a foot pad pivotally mounted to the other end of said bar; and each of said independent biasing means includes a post mounted to the respective bar, a post mounted to said frame and an elastic member securable to said respective bar post and said frame post.

4. The exercise apparatus according to claim 1 wherein said first biasing means comprises separate biasing means for each of said arms which includes:

a first post mounted to said each arm remote from the first end of said each arm;

second and third posts mounted to said frame on opposite sides of a line from said first post to said arm pivot axis; and an elastic member securable to said first post and selectively to said second or third post.

5. The exercise apparatus according to claim 1 further including adjustment means for adjusting the distance between said seat and said foot support assembly.

6. The exercise apparatus according to claim 5 wherein said adjustment means comprises:

a first part of said support member secured to one of said base members;

a second part of said support member secured to the other of said base members and slidable along said support member first part in the direction defined by said longitudinal axis; and means for releasably securing together said support member first and second parts.

7. Exercise apparatus comprising:

a frame having a pair of spaced base members adapted to be supported on a surface and an elongated support member connected to said base members, said support member defining a longitudinal axis of said frame;

a seat fixedly supported on said frame;

a pair of arms each pivotally mounted at a first end of said each arm to said support member remote from a first end of said support member, each of said arms being arranged for pivotal movement about a respective pivot axis transverse to the frame supporting surface, said pivot axes being parallel to each other, said arms extending laterally outward from said frame longitudinal axis and toward said support member first end, and said arms being interconnected so as to pivot one with the other in opposite angular directions;

first biasing means for yieldably biasing said pair of arms selectively in one or the other angular direction;

a pair of thigh supports each mounted to a respective arm remote from the respective arm first end, each of the thigh supports having a support portion and a transverse portion;

a foot support assembly pivotally mounted to said frame remote from said seat about an axis parallel to the frame supporting surface and orthogonal to the frame longitudinal axis; and second biasing means for yieldably biasing said foot support assembly toward said seat;

wherein said first biasing means comprises separate biasing means for each of said arms which includes:

a first post mounted to said each arm remote from the first end of said each arm;

second and third posts mounted to said frame on opposite sides of a line from said first post to said arm pivot axis; and an elastic member securable to said first post and selectively to said second or third post.

8. The exercise apparatus according to claim 7 wherein:

said foot support assembly comprises a pair of independent pivotally mounted foot holder subassemblies; and said second biasing means comprises independent biasing means for each of said foot holder subassemblies.

9. The exercise apparatus according to claim 8 wherein:

each of said foot holder subassemblies includes a bar pivotally mounted to said frame at one end of said bar and a foot pad pivotally mounted to the other end of said bar; and each of said independent biasing means includes a post mounted to the respective bar, a post mounted to said frame and an elastic member securable to said respective bar post and said frame post.

10. The exercise apparatus according to claim 7 wherein each of said arms has a circular gear segment centered at the respective arm pivot axis and secured to the first end of said each arm, the gear segments of the two arms being intermeshed when the arms are mounted to the support member.

11. The exercise apparatus according to claim 7 further including adjustment means for adjusting the distance between said seat and said foot support assembly.

12. The exercise apparatus according to claim 11 wherein said adjustment means comprises:

a first part of said support member secured to one of said base members;

a second part of said support member secured to the other of said base members and slidable along said support member first part in the direction defined by said longitudinal axis; and means for releasably securing together said support member first and second parts.

* * * * *